US006284053B1

(12) United States Patent
Bonomi et al.

(10) Patent No.: US 6,284,053 B1
(45) Date of Patent: Sep. 4, 2001

(54) SELECTIVE DELEADING PROCESS AND BATH FOR PLUMBING COMPONENTS MADE OF A COPPER ALLOY

(75) Inventors: Angelo Bonomi, Locarno (CH); Stefano Carrera, Omegna; Giuliano Franzosi, Arona, both of (IT)

(73) Assignee: Ruvaris S.r.l. (IT)

( * ) Notice: Subject to any disclaimer, the term of this patent is extended or adjusted under 35 U.S.C. 154(b) by 0 days.

(21) Appl. No.: 09/603,976

(22) Filed: Jun. 27, 2000

(30) Foreign Application Priority Data

Mar. 17, 2000 (EP) ..... 00830201

(51) Int. Cl.[7] ..... C23G 1/02

(52) U.S. Cl. ..... 134/3; 134/2; 134/19; 134/22.19; 134/26; 134/28; 134/34; 134/35; 134/36; 134/41; 134/42

(58) Field of Search ..... 134/3, 2, 19, 22.19, 134/26, 28, 34, 35, 36, 41, 42

(56) References Cited

U.S. PATENT DOCUMENTS

| | | | | |
|---|---|---|---|---|
| 4,004,956 | * | 1/1977 | Brindisi, Jr. | 156/666 |
| 4,333,785 | * | 6/1982 | Erickson | 156/281 |
| 4,687,545 | * | 8/1987 | Williams et al. | 156/651 |
| 4,921,571 | * | 5/1990 | Kukanskis et al. | 156/656 |
| 5,017,267 | * | 5/1991 | Cordani | 156/656 |
| 5,411,595 | | 5/1995 | Bokisa, Sr. et al. . | |
| 5,565,039 | * | 10/1996 | Wogenknecht et al. | 134/2 |
| 5,601,658 | | 2/1997 | Marinas et al. . | |
| 5,707,421 | | 1/1998 | Joe . | |
| 5,958,257 | * | 9/1999 | Regelbrugge et al. | 216/2 |

FOREIGN PATENT DOCUMENTS

| | | |
|---|---|---|
| 0683245 | 11/1995 | (EP) . |
| 0695833 | 2/1996 | (EP) . |
| 0892084 | 1/1999 | (EP) . |
| 60149790 | 8/1985 | (JP) . |
| WO 97/06313 | 2/1997 | (WO) . |
| WO 98/30510 | 7/1998 | (WO) . |
| WO 98/30733 | 7/1998 | (WO) . |

* cited by examiner

*Primary Examiner*—Sharidan Carrillo
(74) *Attorney, Agent, or Firm*—Michael Best & Friedrich LLP

(57) ABSTRACT

A process for selectively deleading a plumbing component made of a lead-containing copper alloy. The process comprises traditional pickling the component, washing the component, dipping the component in a deleading bath comprising at least one carboxylic acid selected from the group consisting of formic acid, acrylic acid, propionic acid and butyric acid and traditionally finishing the component.

9 Claims, 1 Drawing Sheet

SELECTIVE DELEADING PROCESS AND BATH FOR PLUMBING COMPONENTS MADE OF A COPPER ALLOY

TECHNICAL FIELD

The present invention relates to a selective deleading process and bath for plumbing components made of a lead-containing copper alloy. Particularly, the present invention relates to a process and a bath which enable a thorough elimination of the copper located on the surface of said components, without in the meantime altering the ratios existing among the other metals forming the alloys.

BACKGROUND OF THE INVENTION

Lead is known to be added in small quantities to copper alloys, such as brass and bronze, in order to favour machining and moulding operations of the pieces made of said alloys. As a consequence of the thermal and mechanical stresses due to the working operations, lead tends to segregate in small globules which emerge to the surface of the pieces. In the case of plumbing components for drinkable water distribution systems, such as taps and valves, this phenomenon is particularly undesirable, because by coming into contact with lead on the surface of said components, water is contaminated in a considerable measure often exceeding the limit of 10 $\mu$g/l recommended by the World Health Organization and laid down by the law in force in some countries, such as the NSF61 in force in USA.

The problem of lead contamination of drinking water has been already tackled and a few methods and processes for the treatment of the surfaces of taps and valves aiming to reduce the superficial lead thereof have been proposed.

EP 0 683 245 describes a process wherein the above mentioned components are treated with a water solution of an acid that forms with lead a substantially water-insoluble compound. The preferred acid for such a treatment is an oxy-acid of phosphorus, for example orthophosphoric acid.

In EP 0 695 833 is described a process based on the use of a two-component solution: the first component promotes the superficial lead dissolution and is formed of chloride ions, whereas the second one complexes the ions in solution, subtracting them to the equilibrium of the dissolution reaction and allowing thus more lead to dissolve. The latter function is performed by pyrophosphate ions.

Patent application WO97/06313 describes a process in two steps. In the first step the brass components are treated with a water solution of a non-oxidizing acid, chosen among sulfamic acid, fluoboric acid, methanesulfonic acid, fluosilicic acid, acetic acid and mixtures thereof, or alternatively are treated with a mixture of an oxidizing acid and a peroxide in water, preferably a mixture of citric acid and hydrogen peroxide. In the second step, which has the purpose of passivating the brass component surfaces, a basic solution of sodium hydroxide, sodium silicate or mixtures thereof having a pH within 10 and 13 is used.

Application EP 0 892 084 describes a single-step process, wherein the brass components are treated with the solution of a detergent and an acid, preferably acetic acid or nitric acid or a mixture thereof.

Patent application WO98/30733 describes another process in two steps. The first step consists in the treatment of brass components with a hot solution of sodium or potassium hydroxide, having a pH higher than 10 and suitable for removing dirt and residues from the casting of such components and for removing most of the superficial lead. The second step consists in dipping said components in a water solution of a carboxylic acid containing 1 to 8 carbon atoms and 1 to 4 carboxylic groups, preferably an acetic acid water solution, in order to complete removal of superficial lead.

Among said known processes, some solve the problem of lead contamination of drinking water by pushing the elimination of said polluting metal under the requested limit, but a consequent technical problem is generated, i.e. the alteration of the chemical composition of the alloy resulting in the deterioration of the treated piece. From the tests carried out, it is clear that the treatments made according to the teachings of said prior art patents provide for lead elimination, but at the same time also the other constituents of brass or bronze are attacked. Therefore, owing to these treatments, the alloy chemical composition is modified, resulting in a deterioration of the component aesthetic appearance. In some cases, even a change of the color of said components from yellow to red was noticed, indicating the increased copper percentage. However, none of the above listed patents considers the problem of selectivity in lead elimination.

SUMMARY OF THE INVENTION

Object of the present invention is providing a process for the thorough elimination of the superficial lead of plumbing components made with copper alloys which is free from said drawbacks. Said object is achieved according to the present invention by means of a traditional pickling process which is made selective by dipping the treated and washed pieces in a deleading bath before the usual finishing step. The main features of the deleading process according to the present invention are specified in the first claim and further features are specified in the following claims. Further, the present invention comprises a selective deleading bath whose features are specified in claim 7 and following claims.

An advantage of the deleading process according to the present invention consists in that it enables lead which is located on the surface of said components to be eliminated in a very thorough way, thus reducing lead release in water under the limit of 10 $\mu$g/l laid down by the strictest laws and in the meantime is substantially inactive towards the other metals forming the alloy.

Another advantage of the deleading process according to the present invention consists in that it can be successfully used not only in the treatment of brass, but also in that of bronze and of other metal alloys whose main constituent is copper.

An advantage of the deleading bath according to the present invention is the economicity thereof. In facts, it allows treating a large number of pieces by maintaining unchanged its effectiveness; as a result the use thereof involves a considerable economic gain with respect to the prior art.

Another advantage of the deleading bath according to the present invention consist in that it does not require the use of solutions containing fluorides or other highly dangerous substances.

Further advantages and features of the selective deleading process and bath according to the present invention will appear to those which are skilled in the art from the following detailed description of some embodiments thereof with reference to FIG. 1 that graphically shows the variation of the lead and zinc quantities dissolved in the deleading bath as a function of the quantity of treated brass.

DESCRIPTION OF THE PREFERRED EMBODIMENT

Figure 1:
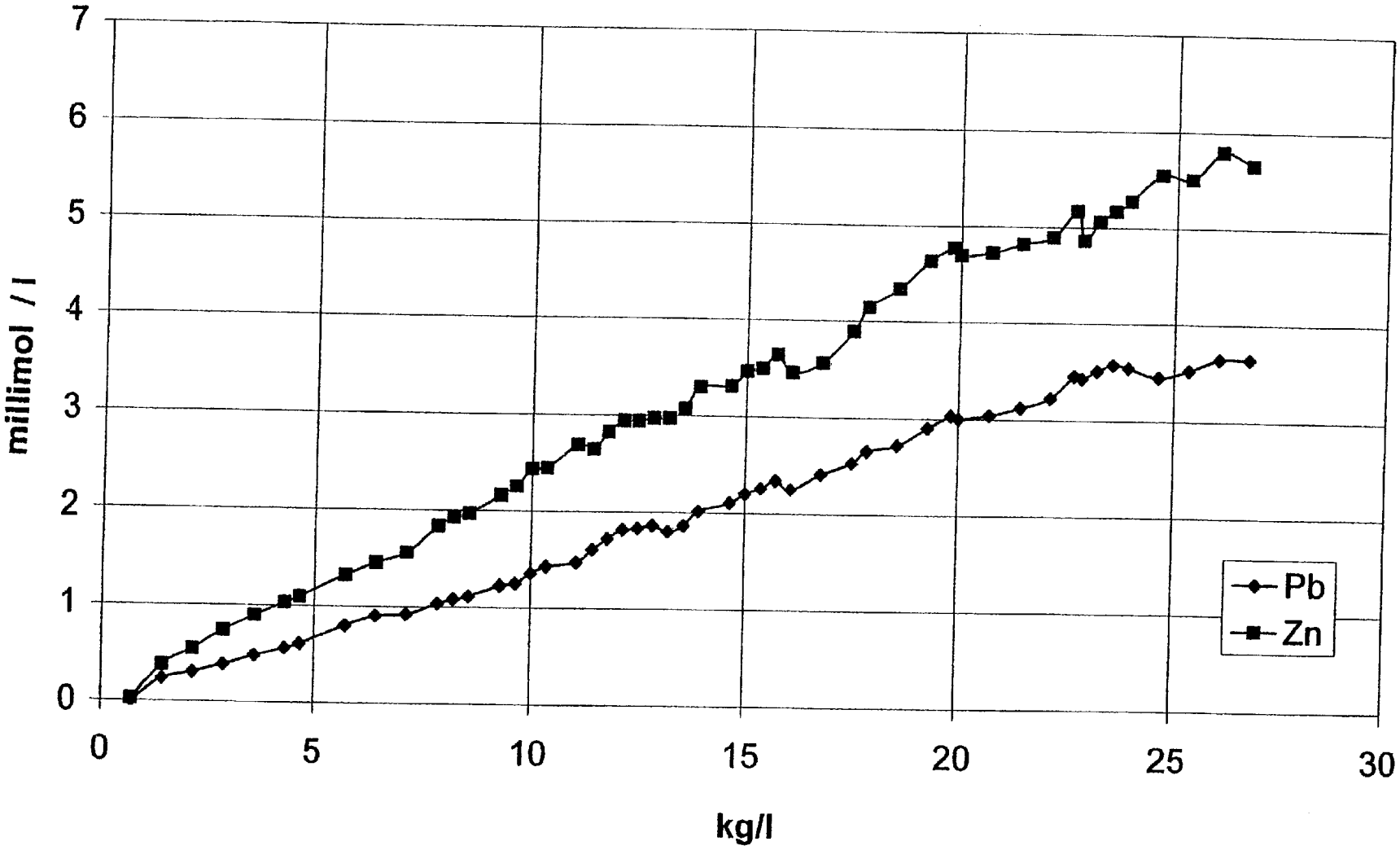
FIG. 1 is a graph showing the variation of the lead and zinc quantities dissolved in the deleading bath as a function of the quantity of treated brass.

The deleading process according to the present invention consists in a traditional pickling process wherein, before the finishing step, the treated and washed pieces are dipped in a deleading bath containing at least one carboxylic acid selected from the group consisting of formic acid, acrylic acid, propionic acid and butyric acid. Also mixtures of said acids can be advantageously used in the preparation of baths useful for carrying out the process according to the present invention.

Said deleading step, which is carried out by dipping the components in a bath formed of a water solution containing one of said carboxylic acids or a mixture thereof, has the purpose of selectively solubilizing the lead which is located on the surface of said components. In order to speed this solubilization, said bath is preferably constantly stirred so as to favour the continuous change of the liquid in contact with the surface of the components which are subjected to the deleading step.

The carboxylic acid concentration in the deleading bath can vary according to the conditions of use and of the quantity of lead on the surface of the pieces to be treated. It is generally within 0.01 and 1 mol/l, preferably within 0.01 and 0.5 mol/l.

Further the deleading bath can contain a surfactant in a concentration within 0.1 and 10%. Preferred surfactants are those based on coconut quaternary ethoxylated alkylamines.

The deleading bath temperature whereat the deleading step is carried out is suitably within 15 and 45° C., preferably within 35 and 40° C.

A number of organic and non-organic acids have been tested with respect to their lead dissolution capacity and their selectivity towards this metal with respect to the other alloy constituents. The results of these tests, given in the following examples 1 and 2, prove that, temperature and duration of the treatment being equal, formic, acrylic, propionic and butyric acids are more selective towards lead than the acids used in the deleading processes according to the state of the art.

EXAMPLE 1

A brass fitting having weigh of 210 g and surface of 188 $cm^2$ containing 2.5% of lead was first dipped for 3 minutes in 250 ml of a 3% degreasing bath of commercial type (E44) having the temperature of 50° C. Then, the fitting was washed with lots of water and subsequently dipped for 10 minutes in 250 ml of a bath formed of a water solution of one acid among the followings. The bath temperature was 40° C. The concentrations of all acid solutions were 0.1M, but for tie flouridric acid whose concentration was 2M. After removing the fitting, a sample was taken from said solution and the concentrations of Cu, Zn and Pb were determined therein by flange absorption spectroscopy. The results of said determinations are given in Table 1.

TABLE 1

| ACID IN THE BATH | Pb (ppm) | Zn (ppm) | Cu (ppm) |
|---|---|---|---|
| Formic acid | 7.625 | 3.745 | 0.071 |
| Acrylic acid | 6.135 | 4.440 | 0.188 |
| Propionic acid | 6.120 | 2.860 | 0.038 |
| Butyric acid | 5.125 | 4.480 | 0.066 |
| Sulfamic acid | 6.970 | 6.390 | 0.049 |
| Fluoridic acid | 5.910 | 8.490 | 0.770 |

By comparing the above results, it can be seen that all the tested acids are effective in dissolving lead. However, whereas sulfamic and fluoridric acid involve the contemporaneous dissolution of considerable quantities of zinc, the other acids are very selective towards lead, that is, they dissolve very well this metal, less the zinc and hardly the copper.

EXAMPLE 2

800 ml of a deleading bath A containing acetic acid 0.2M and 0.5% by weight of Berol commercial surfactant and 800 ml of a similar bath B containing acrylic acid 0.2M and 0.5% by weight of the same surfactant added to solution A were prepared.

48 brass manifolds, weighting 64 g each and having a total surface of 5398 $mm^2$ were first treated in a known way in an acid bath and then washed with water from the tap.

Then, 24 of the so treated and washed manifolds were subjected to deleading by dipping them in bath A for 20 minutes at the temperature of 40° C. The remaining 24 treated and washed manifolds were dipped in bath B for the same time and at the same temperature. After said deleading operation, both from bath A and from bath B were taken samples which were subjected to a quantitative analysis of the Pb, Zn and Cu content, made through flame atomic absorption. The results of such analyses are given in the following table.

TABLE 2

| | Pb (ppm) | Zn (ppm) | Cu (ppm) |
|---|---|---|---|
| Bath A (0.2M acetic acid + surfac.) | 108.4 | 91.0 | 2.87 |
| Bath B (0.2M acrylic acid + surfac.) | 64.5 | 35.2 | 0.01 |

By comparing these results, it may be inferred that the bath containing acetic acid is capable of extracting a larger quantity of metals than that containing acrylic acid. However, the latter bath is more selective towards lead. In facts, the ratio between the ppm of Pb and Zn is 1.8 for the treatment with bath B (acrylic acid solution) whereas it is only 1.2 for that carried out by bath A (acetic acid solution). Besides, the latter acid attacks also copper, whereas acrylic acid is almost inactive towards copper, as the above given table shows. Therefore, it may be stated that the bath containing acrylic acid is selectively deleading, whereas the one containing acetic acid is more generally pickling.

EXAMPLE 3

The following test was carried out with the purpose of determining the maximum quantity of brass components that a volume of bath containing acrylic acid is capable of deleading.

Raw brass manifolds with two ways having the diameter of ¾ inch, weighing 210 g each, total surface 18817 $mm^2$ and internal volume 28 ml, were subjected to the first step of a traditional pickling by dipping them in an acid bath and then washed with water. Subsequently, said manifolds were dipped 12 at a time, for a period of 15 minutes, in a vat having internal volume of 141 filled with a bath comprising a solution of 0.2M acrylic acid and Berol 0.5% by weight as surfactant. The bath was kept at a temperature of 40° C. and subjected to continuous stirring. A sample of said bath was taken every 5 kg of treated brass, and the samples were subsequently analyzed in order to determine the Pb, Zn and Cu concentrations therein by means of flame atomic absorption. The results of the analyses for Pb and Zn carried out for the 50 taken samples are graphically shown in FIG. 1. However, the Cu concentration in the samples was so small that no instrument reading compared with the other two metals was possible. By considering FIG. 1, it can be noted that the quantities by moles of lead and zinc increase regularly as a function of the number of treated manifolds up to more than 25 kg of brass treated per liter of bath. Therefore, it may be stated that the deleading power of the solution according to the present invention is substantially unchanged at least up to this limit of 25 kg of brass per liter of solution. Although apparently the quantity of zinc in the solution is greater than that of lead, it must be considered that zinc forms the 35% by weight of the brass alloy, whereas lead forms only the 3% thereof.

EXAMPLE 4

Two baths, each one containing one liter of 0.2M acrylic acid solution and 5% Berol commercial surfactant were prepared. A number of bronze valves of different sizes, already subjected to the first step of a traditional pickling process and washed with water, were dipped in the first bath which was kept under continuous stirring and at a temperature of 40° C. The percent composition of bronze was the following: Cu: 86.08; Pb: 4.50; Sn: 5.22; Ni: 0.72; Zn: 3.42; Fe: 0.06.

A sample of said bath was taken after 1230, 2040, 2888 and 3593 g of treated bronze respectively, and the resulting four samples (samples 1–4) were subsequently analyzed in order to determine therein the Pb, Zn and Cu concentrations by flame atomic absorption. The results are listed in the following Table 3.

Valves of different sizes made of brass containing 2.2% by weight of lead were dipped one after the other in the second bath, also kept under stirring and at a temperature of 40° C. After treating 3590 g of brass, from said second bath a sample 5 was taken and the lead content therein was determined by flame atomic absorption. The result of said analysis is given in the last line of the following table.

TABLE 3

| | Pb (ppm) | Zn (ppm) | Cu (ppm) |
|---|---|---|---|
| Sample 1 (treat. bronze 1230 g) | 103.0 | 7.0 | 0.10 |
| Sample 2 (treat. bronze 2040 g) | 165.0 | 14.0 | 0.12 |
| Sample 3 (treat. bronze 2888 g) | 195.0 | 14.0 | 0.19 |
| Sample 4 (treat. bronze 3593 g) | 231.4 | 18.5 | 0.18 |
| Sample 5 (treat. brass 3590 g) | 100.0 | Not determined | Not determined |

The results obtained for samples 1–4 prove that, even in the treatment of bronze, the bath according to the present invention selectively extracts lead which is present on the surface of the valves and leaves the percentage of copper and zinc in the alloy substantially unchanged. Further, from comparison of samples 4 and 5 it may be inferred that the quantity of lead detected in sample 4 is double than that detected in sample 5, just as double is the percentage by weight of lead in bronze with respect to brass.

What is claimed is:

1. A process for selectively deleading a plumbing component made of a zinc-and-lead-containing copper alloy, the process comprising the following steps in order:

pickling the component in an acid bath;

washing the component;

removing lead and zinc contaminants from the component by treating the zinc-and-lead-containing copper alloy with a deleading bath comprising acrylic acid and a surfactant; and determining the ratio of removed lead and zinc to be 1.8 by analyzing the deleading bath.

2. The process according to claim 1 wherein washing the component further comprises washing with water.

3. The process according to claim 1, wherein the deleading bath is kept at a temperature within 15 and 45° C.

4. The process according to claim 1, wherein during removing lead and zinc contaminants, the deleading bath is kept under stirring.

5. The process according to claim 1, wherein said zinc-and-lead-containing copper alloy is brass or bronze.

6. The process according to claim 1, wherein the concentration of acrylic acid is within 0.01 and 1 mol/l.

7. The process according to claim 1, wherein said surfactant is contained in said deleading bath in a quantity by weight within 0.1 and 10%.

8. The process according to claim 3, wherein the deleading bath is kept at a temperature within 35 and 40° C.

9. The process according to claim 6, wherein the concentration of the acrylic acid is within 0.01–0.5 mol/l.

* * * * *